US011440280B2

(12) United States Patent
Oksenhendler

(10) Patent No.: US 11,440,280 B2
(45) Date of Patent: Sep. 13, 2022

(54) CRANK PRESS

(71) Applicants: Mark Oksenhendler, Tel Aviv (IL); Marina Oksenhendler, Tel Aviv (IL); Alexander Kasianenko, Tel Aviv (IL)

(72) Inventor: Mark Oksenhendler, Tel Aviv (IL)

(73) Assignees: Mark Oksenhendler, Tel Aviv (IL); Marina Oksenhendler, Tel Aviv (IL); Alexander Kasianenko, Tel Aviv (IL)

( * ) Notice: Subject to any disclaimer, the term of this patent is extended or adjusted under 35 U.S.C. 154(b) by 0 days.

(21) Appl. No.: 17/372,467

(22) Filed: Jul. 11, 2021

(65) Prior Publication Data

US 2022/0176666 A1 Jun. 9, 2022

Related U.S. Application Data

(63) Continuation-in-part of application No. PCT/IL2020/051274, filed on Dec. 9, 2020.

(51) Int. Cl.
*B30B 1/26* (2006.01)
*B21J 9/18* (2006.01)

(52) U.S. Cl.
CPC ..... *B30B 1/263* (2013.01); *B21J 9/18* (2013.01); *B30B 1/266* (2013.01)

(58) Field of Classification Search
CPC .. B30B 1/263; B30B 1/266; B21J 9/02; B21J 9/18
See application file for complete search history.

(56) References Cited

U.S. PATENT DOCUMENTS

2006/0101891 A1 5/2006 Shin et al.
2006/0144258 A1 7/2006 Tang et al.
(Continued)

FOREIGN PATENT DOCUMENTS

EP 0941832 A1 9/1999
GB 2142263 A 1/1985
KR 20030093647 A 6/2002

OTHER PUBLICATIONS

PCT International Search Report for International Application No. PCT/IL2020/051274, dated Feb. 1, 2021, 4pp.

*Primary Examiner* — Gregory D Swiatocha
(74) *Attorney, Agent, or Firm* — The Roy Gross Law Firm, LLC; Roy Gross

(57) ABSTRACT

A crank press with an adjustable stroke comprises a press frame having a frame slideways therewithin with a slider reciprocatively movable therealong and supported by a pneumatic cylinder. In order to significantly increase a working force, a length of the working stroke and efficiency, the crank press further comprises: at least two mutually synchronized crank drives configured for reciprocatively moving the slider along the frame slideways, a lever-crosspiece mechanism having at least one pair of threaded guide stanchions secured within the frame bed, a crosspiece slidably mounted on the guide stanchions atop the slider, at least two two-arm levers hingedly connected to the slider supportadly on the crosspiece, at least one pair of crosspiece stop nuts engaged with threads of the guide stanchions and configured for arresting the cross-piece at the moment of applying a force to the slider by the lever and a switching arrangement for slider reversal with regulation of its stroke.

17 Claims, 13 Drawing Sheets

(56) References Cited

U.S. PATENT DOCUMENTS

| | | | | |
|---|---|---|---|---|
| 2009/0260460 | A1* | 10/2009 | Darr | B30B 15/14 74/49 |
| 2019/0322029 | A1* | 10/2019 | Vantrease | B30B 1/14 |
| 2020/0238356 | A1* | 7/2020 | Kneer | B44B 5/024 |

* cited by examiner

CRANK PRESS

CROSS REFERENCE TO RELATED APPLICATIONS

This is a US Continuation-in-Part Application which claims priority and the benefit to PCT Patent Application PCT/IL2020/051274 filed Dec. 9, 2020 which is incorporated by reference herein in its entirety.

FIELD OF THE INVENTION

The present invention relates to a crank pressing machine and, more particularly, to a pressing machine provided with a lever mechanism of consecutive motion of a press slider.

BACKGROUND OF THE INVENTION

Crank presses for hot and cold forging and stamping are known in the art (see, for example, U.S. Pat. No. 4,646,551) and belong now to public domain. In the field of heavy forging and stamping presses, the hot forging crank press of Tjazhmekhpress has nominal capacity of 16500 tons of force. Its counterpart of Sumitomo Heavy Industries, Ltd. generates force up to 8000 tf.

Analysis of the existing technical solutions indicates that enhancement of generated force is possible by means of upscaling the eccentric shaft, that has some constructive limits. Multi-crank arrangements are also too complicated and labor consuming.

The works of all friction forces in the crank-rod mechanism is relatively similar to the useful yield. Specifically, the slider stroke at deformation of an article to be treated is 4-5 times less than the displacement of the point of application the equivalent friction force along its trajectory. In this case, high values of efficiency are unachievable.

In crank presses, a large part of the rod stroke is used for providing a space for inserting a work-piece.

Thus, there is a long-felt need to provide a more powerful crank press characterized by high efficiency and free of the abovementioned drawbacks.

SUMMARY OF THE INVENTION

It is hence one object of the invention to disclose a crank press with an adjustable stroke; the press comprising: (a) a press frame having a frame slideways therewithin with a slider reciprocatively movable therealong and supported by a first pneumatic cylinder; (b) at least two mutually synchronized crank drives configured for reciprocatively moving the slider along the frame slideways; each crank drive comprising a main motor, a flywheel, a controllable clutch, a pinion shaft, a first crank shaft and a connecting rod kinematically connected in series such that the connecting rod moves the slider in downward and upward manners.

It is a core purpose of the invention to provide the press further comprises a lever-crosspiece mechanism further comprising: (a) at least one pair of threaded guide stanchions secured within the frame bed; (b) a first crosspiece slidably mounted on the guide stanchions atop the slider; (d) at least two two-arm levers slidably movable along a lower surface of the first crosspiece; the shorter arm of the two-arm lever is hingedly connected to the slider; a longer arm of the two-arm lever is hingedly connected to a rod nut by a rod nut arrangement; (e) at least one pair of first-crosspiece stop nuts engaged with threads of the guide stanchions and configured for arresting the cross-piece at the moment of applying a force to the slider by the lever; and (f) a nut arrangement threadly movable along a distal terminal of the connecting rod.

While the longer arm of the two-arm lever is driven by the connecting rod upward, a shorter arm of the two-arm lever being slidably supported by the first crosspiece retained by the first-crosspiece stop nuts belonging thereto applies a force generated by the crank drive to the slider;

While the connecting rod moves downward, the shorter arm of the two-arm lever eases the force applied between the first crosspiece and the slider and allows the first crosspiece to descend; the first-crosspiece stop nuts driven by the worm gears follow the first crosspiece.

Another object of the invention is to disclose the first-crosspiece stop nuts driven by worm gears kinematically constantly engaged with the first-crosspiece stop nuts; the worm gears are kinematically connected to one of the crank drive in a releasable manner.

A further object of the invention is to disclose the crank press comprising a first length-adjustable splined shaft rotatable around a stationary threaded pintle by a pusher mechanically connected to the first crosspiece. The pusher is configured for applying an axially directed thrust to the first splined shaft such that a rotational torque is generated. The first splined shaft is kinematically constantly engaged with the first-crosspiece stop nuts.

A further object of the invention is to disclose the crank press comprising at least one pair of slider stop nuts configured for arresting the slider and preventing a backblow due to an elastic deformation of an article to be pressed. The slider stop nuts are kinematically connected to one of the crank drives via worm gears. The worm gears driving said slider stop nuts are connected to said crank drive in parallel to said worm gears driving said first-crosspiece stop nuts via a differential transmission.

A further object of the invention is to disclose the crank drive comprising at least one second crank shaft mounted in parallel with said first crank shaft. The first crankshaft and at least one second crankshaft are engaged with the pinion shaft and driven thereby. The crank drive comprises a rocker connected to crank pins of the first and at least one second crank shafts. A proximal terminal of the connecting rod is hingedly connected to a middle of the rocker.

A further object of the invention is to disclose the crank press comprising a connecting rod nut arrangement drive moving the connecting rod nut arrangement along the distal terminal of the connecting rod and configured for compensating displacement of the first crosspiece. The connecting rod nut arrangement drive comprises a second threaded rod kinematically connected to the first crosspiece and rotatable within a stationary threaded bore according to the displacement of the first crosspiece. A second splined shaft is length-adjustable in order to compensate the periodic displacements of the connecting rod and kinematically connected to the threaded rod and engaged with a connecting rod warm shaft driven by the threaded rod via the splined shaft engaged with an articulated shaft engaged with a bevel transmission such that spatial positions of the first crosspiece and connecting rod nut arrangement are mutually coordinated.

A further object of the invention is to disclose the crank press comprising a first auxiliary reverse stroke drive, switching mechanism and a lower stop, wherein the drive is synchronized with one of the crank shafts, and the switching mechanism further comprises a switch clutch configured for coupling the differential transmission and worm gears driving the stop nuts to the crank drive and auxiliary reverse stroke drive in an alternative manner. The lower stop is applied to stop the cross-piece at its adjustable penultimate stroke point to get the precise die closing.

A further object of the invention is to disclose a second auxiliary reverse stroke drive comprises a chain wheel gear arrangement comprising at least two sprockets and a chain tensioned therebetween partially ascendably movable in parallel with the pusher bar; at least one of the sprockets is constantly kinematically connected to the crank shaft. The chain carries a supporting roll engageable with the pusher bar at an ascending part of movement trajectory thereof such that the first length-adjustable splined shaft is pushed by the pusher bar and rotates around the pintle in a reversed direction.

A further object of the invention is to disclose each of the worm gears of the stop nuts comprises a second pneumatic cylinder accommodating a compressed gas therewithin and having a piston with a stick connected to worm shaft of the worm gear by a thrust bearing such that the second pneumatic cylinder perceives non-linearity of slider motion.

A further object of the invention is to disclose the crank press comprising a mechanism configured for switching the switch clutch at a back-stroke phase of the slider and vice versa.

A further object of the invention is to disclose the crank press comprising a lower switching arrangement for reversing the slider after reaching a lowest point of a working stroke thereof.

A further object of the invention is to disclose the crank press comprising an upper switching arrangement with an upper stop to stop the cross-piece at its upper stroke point and for reversing the slider after reaching a highest point of a reverse stroke to get the precise work stroke of the slider thereof.

A further object of the invention is to disclose at least one pair of stop nuts comprising a self-locking thread.

A further object of the invention is to disclose the crank press comprising a grip arrangement for precisely positioning the slider before a last operational cycle in a base position. The grip arrangement further comprises a spring-loaded grip kinematically connected to the pusher and configured for latching the slider in the base position before the last operational cycle and a spring gas cooperatively operating with the first pneumatic cylinder and activated when the slider is positioned at and below than the base position.

A further object of the invention is to disclose the spring-loaded grip having gripping and idle positions; the spring-loaded grip latches the slider in the gripping position when the slider descends to a position thereof lower than the base position and is shifted into the idle position by a fixing bar kinematically connected to the pusher via a knee lever comprises a spring-loaded fixing bar.

A further object of the invention is to disclose the crank press comprising: (a) a second crosspiece mounted on the guide stanchions; the second crosspiece mounted under the first crosspiece; (b) a slider table rigidly connected to the slider and movably mounted on the guide stanchions between the first and second crosspiece; (c) at least two first and two second two-arm levers oriented opposite to each other; the first and second two-arm levers are slidably movable over a upper surface of the slider table and a lower surface of the second crosspiece, respectively; the shorter arms of the first and second two-arm lever are hingedly connected to a lower surface of the first crosspiece and an upper surface of the slider, respectively; longer arms of the first and second two-arm levers are hingedly connected to the first and second connecting rod nut arrangements, respectively; (d) at least two pair of stop nuts thereon engaged with threads of the guide stanchions and configured for arresting the first and second cross-pieces at a moment of applying a force thereon by the levers; the at least two pairs of stop nuts are releasably kinematically connected to one of the crank drives via a differential transmission and worm gears driving the crosspiece nuts belonging to first and second crosspieces independently; (e) first and second connecting rod nuts arrangements threadly movable along a distal terminal of the connecting rod;

While the longer arms of the first and second two-arm levers are driven by the connecting rod upward, a shorter arm of the first two-arm lever eases pressure on the slider table and a shorter arm of the second two-arm lever slidably supported by the second crosspiece arrested by the nuts belonging thereto applies a force generated by the crank drive to the slider. The nuts belonging to the first crosspiece driven by the worm gears follow the first crosspiece.

While the longer arms of the first and second two-arm levers are driven by the connecting rod nut arrangement downward, the shorter arm of the first two-arm lever hingedly supported by the lower surface of the first cross-piece arrested by the stop nuts belonging thereto applies a force generated by the crank drive to the slider table and moves the slider. The shorter arm of the second two-arm lever eases pressure on the slider. The nuts belonging to the second crosspiece driven by the worm gears follow the second crosspiece.

A further object of the invention is to disclose a lifting machine, being an alternative embodiment of the similar to the present above crank press mechanical arrangement, the unifying characteristics of which with the crank press are:

(a) a system of slider and first cross-piece, connected and moving together in the vertical direction, i.e. a system equivalent to the slider according to crank press kinematic schemes, (b) the second cross-piece, located under the first one, (c) cross-pieces stop nuts, (d) lever-cross-piece drive, e. threaded stanchion, (f) crank drive; the machine, which kinematic scheme is also applicable for stackers and machines, that generate press force vertically upward and in the horizontal direction—drawing presses, bending presses, briquetting, extrusion machines, other machines for mechanical processing of materials by pressure.

The lifting machine comprises: (a) a base member, (b) a crank drive; and (c) a vertically movable slider.

It is another core purpose of the invention to provide the lifting machine further comprises a lever-crosspiece mechanism further comprises: (a) first and second stanchions vertically secured to the base member; second stanchion threaded therealong; and (b) first and second crosspieces movably mounted on the second stanchion; the second crosspiece mounted under the first crosspiece; the slider being movable along the first stanchion is supported by its cantilever on an intermediate link which is a pipe with end spherical surfaces, which supports on the according spherical surface of the collar of the first cross-piece to exclude a rigid connection in a transverse plane between the slider and the first crosspiece; the second stanchion is provided with a non-self-locking thread; each of the first and second cross-pieces comprising a conical nut mounted within a tapered bore of the first and second crosspieces; the nuts threadly coupled with the second stanchion; the conic nuts are stoppable on the second stanchion in a self-locking manner by a gravitational force applied by the crosspieces and a load to be lifted to the conic nuts within the bore and are rotationally movable along the second stanchion in an non-self-locking manner by applying a force to the conic nuts relative to the crosspiece in a direction of ejecting the conic nut out of the bore of the crosspiece; each of the first and second crosspieces comprising an arrangement for reducing the distributed contact normal forces between the conic nuts and corresponding tapered bores thereof; and (c) a two-arm lever hingedly connected to the second crosspiece; the two-arm lever having a longer arm connected to the crank drive such that the crank drive swingingly moves the two-arm lever around a hinge axis thereof.

While the terminal point of the longer arm of the two-arm lever is moved downward by the reciprocative drive, a short arm of the two-arm lever applies a force generated by the reciprocating drive to the first crosspiece such that the first crosspiece ascends and the spring-loaded conical nut belonging thereto follows the first crosspiece along the second stanchion. the second crosspiece hingedly supports the two-arm lever while the conical nut belonging to the second crosspiece is locked and the second crosspiece is steady relative to the second stanchion.

While the terminal point of the longer arm of the two-arm lever is moved upward by the crank drive, the second crosspiece is pulled up; the second crosspiece ascends along the second stanchion. The conical nut belonging to the second crosspiece rotationally follows the second crosspiece.

A further object of the invention is to disclose the lifting machine comprising a descending arrangement comprising an auxiliary drive and two releasing bushings kinematically connected to the auxiliary drive. The two releasing bushings are configured for reduction of a contact normal forces between the tapered bores and the conical nuts such that a friction force between the tapered bores and the conical nuts is reduced.

A further object of the invention is to disclose the auxiliary drive which is a manual drive.

A further object of the invention is to disclose a lifting machine comprising: (a) a base member; (b) a crank drive; and (c) a vertically movable slider;

It is another core purpose of the invention to provide the lifting machine further comprising a lever-crosspiece mechanism further comprising: (a) first and second stanchions vertically secured to the base member; second stanchion threaded therealong; and (b) first and second crosspieces movably mounted on the second stanchion; the second crosspiece mounted under the first crosspiece; the slider being movable along the first stanchion is supported by the first crosspiece; the slider being supported by a cantilever on an intermediate link, which is a pipe with end spherical surfaces, is supported through this pipe on the accordant spherical surfaces of a collar of the first crosspiece to exclude a rigid connection in a transverse plane between the slider and the first crosspiece; the second stanchion is provided with a non-self-locking thread; each of the first and second crosspieces comprising a multi-disc clutch nuts mounted within bores of the first and second crosspieces; each of the multi-disc clutch nuts having internal engagement frictional discs mounted between the external engagement disks in the bores of the first and second crosspieces; and the multi-disc clutch nuts threadly coupled with the second stanchion; the multi-disc clutch nuts are stoppable on the second stanchion in a self-locking manner when loaded with a gravitational force applied by the crosspieces and a load to be lifted to the multi-disc clutch nuts within the bores and are rotationally movable along the second stanchion in an non-self-locking manner by applying a force to the multi-disc clutch nut relative to the crosspiece in a direction of ejecting the multi-disc clutch nut out of the bore of the crosspiece; each of the first and second crosspieces comprising an arrangement for reducing the contact normal forces between the clutch discs; (c) a two-arm lever hingedly connected to the second crosspiece; the two-arm lever having a longer arm connected to the crank drive such that the crank drive swingingly moves the two-arm lever around a hinge axis thereof; while the longer arm of the two-arm lever is moved downward by the reciprocating drive, a short arm of the two-arm lever applies a force generated by the reciprocating drive to the first crosspiece such that the first crosspiece ascends together with the multi-disc clutch nut belonging thereto, while the multi-disc clutch nut rotationally moves along the second stanchion in a non-self-locking manner; the second crosspiece hingedly supports the two-arm lever while the multi-disc clutch nut belonging to the second crosspiece is locked and the second crosspiece is steady relative to the second stanchion; while the longer arm of the two-arm lever is moved upward by the crank drive, the second crosspiece is pulled up; the second crosspiece ascends along the second stanchion; the multi-disc clutch nut belonging to the second crosspiece rotationally moves along the second stanchion.

BRIEF DESCRIPTION OF THE DRAWINGS

In order to understand the invention and to see how it may be implemented in practice, a plurality of embodiments is adapted to now be described, by way of non-limiting example only, with reference to the accompanying drawings, in which.

DETAILED DESCRIPTION OF THE INVENTION

The following description is provided, so as to enable any person skilled in the art to make use of the invention and sets forth the best modes contemplated by the inventor of carrying out this invention. Various modifications, however, are adapted to remain apparent to those skilled in the art, since the generic principles of the present invention have been defined specifically to provide a crank press and a lifting machine.

Figure 1:
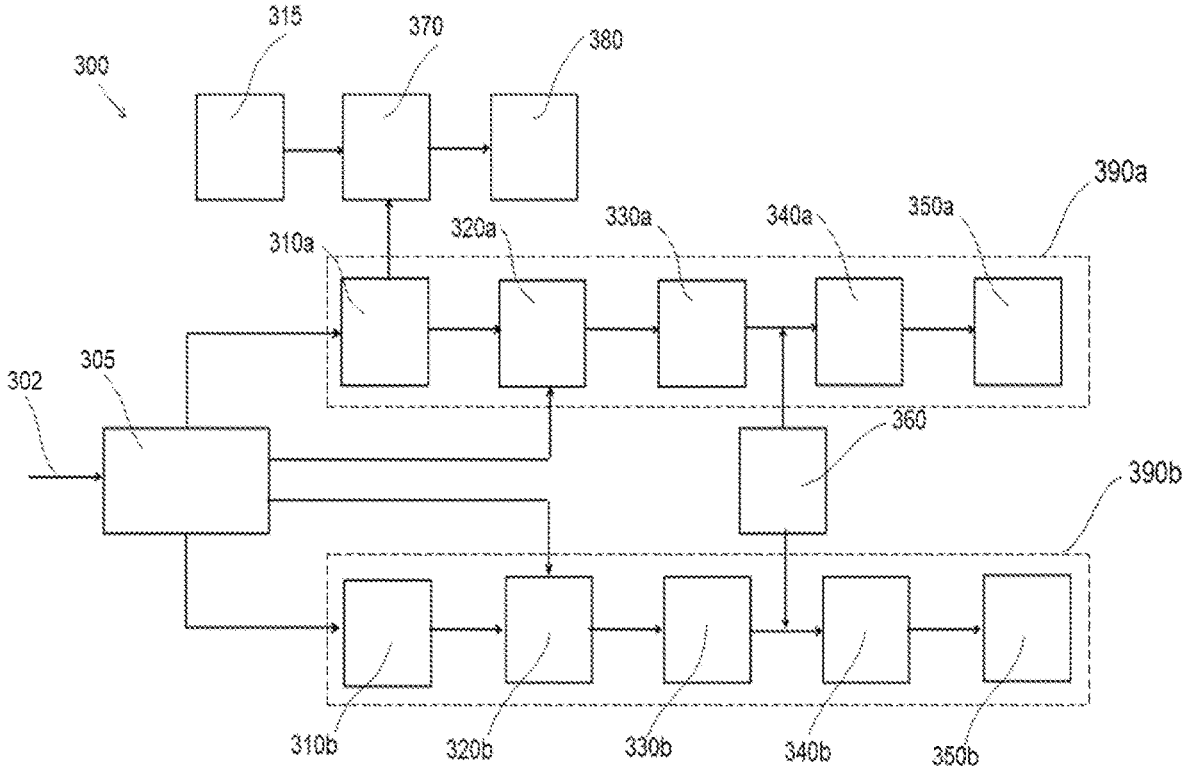
FIG. 1 is a schematic block diagram of a crank press.

Reference is now made to FIG. 1 presenting a block diagram of crank press 300. Electric power feeder 302 is connected to control unit 310 activates and disactivates drives and mechanism of crank press 300. The aforesaid press comprises at least two mutually kinematic chains 390*a* and 390*b* synchronized by linkage 360. Control unit 305 energizes main electric motors 310*a* and 310*b* transferring a rotational torque to clutches 320*a* and 320*b* which are activatable by control unit 310. Main electric motors 310*a* and 310*b* transfer rotation to crank shafts 330*a* and 330*b* via clutches 320*a* and 320*b*. Consecutively connected main electric motors 310*a* and 310*b*, clutches 320*a* and 320*b* and crank shafts 330*a* and 330*b* form two parallel kinematic chains of crank drives of crank press. Crank shafts 330*a* and 330*b* convert rotational movement into reciprocal movement of connecting rod-lever mechanisms 340*a* and 340*b* configured to move a slider (not shown). The aforesaid slider is intermittently movable by connecting rod-lever mechanisms 340*a* and 340*b*. An elemental vertical displacement of the slider corresponds one revolution of crank shafts 330*a* and 330*b*. It should be emphasized that, in the course of slider movement, an articulation point between a connecting rod and a lever should be displaced along the connecting rod in accordance with vertical displacement of the slider. Tracking mechanisms 350*a* and 350*b* are configured for adjusting the position of the articulation point according to the current position of the crosspieces.

Reverse stroke of the slider is performed by auxiliary servodrive 315 connectable by switchable clutch 370. Numeral 380 refers to switching mechanism configured for switching the direction of motion of slider from the reverse stroke to the forward stroke and vice versa.

Figure 2:
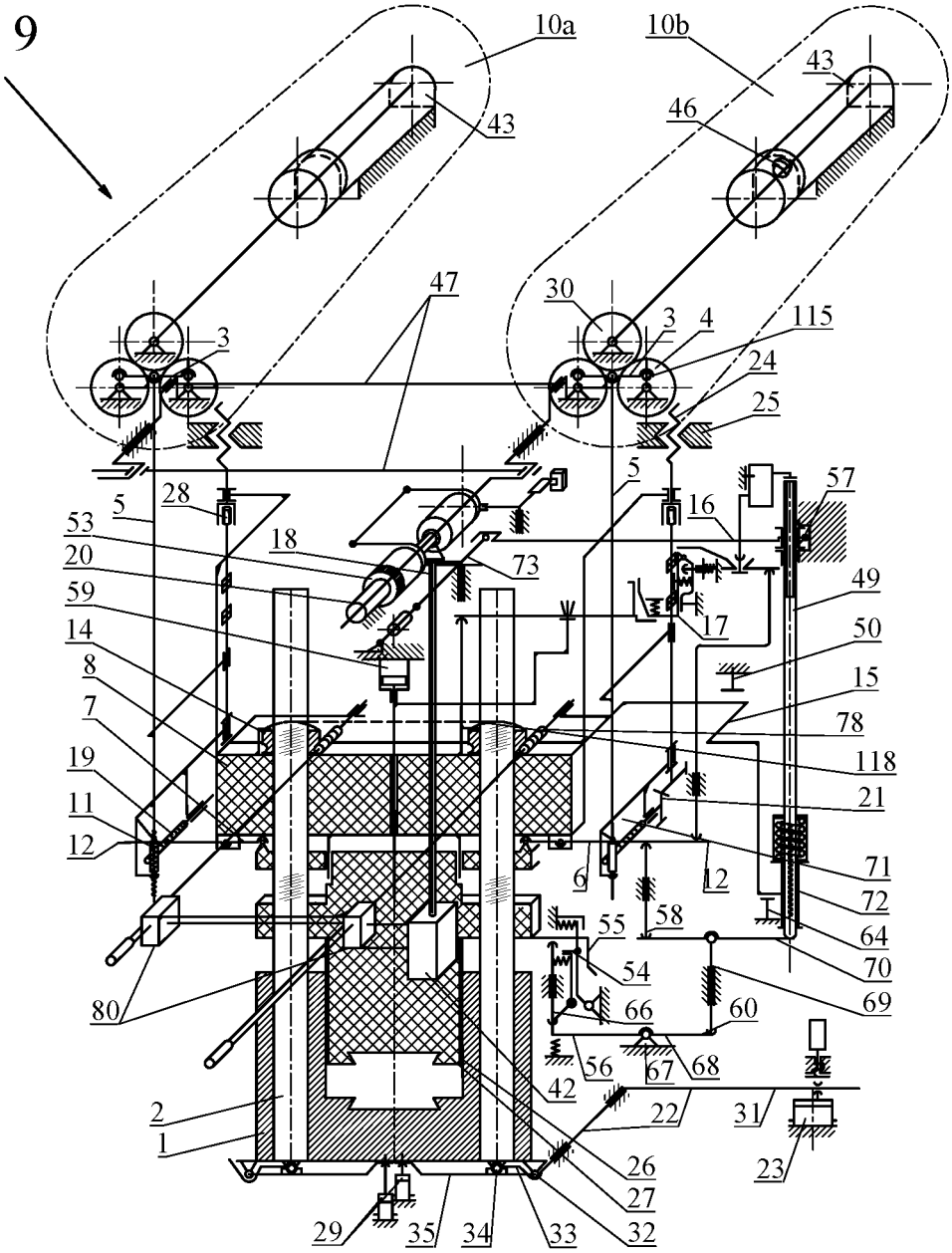
FIG. 2 is a kinematic scheme of a crank press provided with a nut-retainable crosspiece.

Reference is now made to FIG. 2 presenting a kinematic scheme depicting the basic embodiment 9 of the present invention. Embodiment 9 comprises base 1 and at least two stanchions 2 secured within base 1. Slider 27 is vertically movable in guiding ways 26. Crosspiece 8 is vertically movable along stanchions 2. Stop nuts 13 and 14 are rotatably movable along a threaded part of stanchions 2.

Numerals 10*a* and 10*b* refer to two parallel crank drives. Each of crank drives 10*a* and 10*b* includes consecutively connected main electric motor 43 provided with a flywheel (not shown), controllable clutch 46, gear shaft 30 and crank shafts 4. The flywheel functions are for dynamic balancing of the mechanism and as kinetic energy storage element for a press operation. After energizing main electric motor 43 by the control unit (not shown) and spinning the flywheel up to the predetermined rpm, clutch 46 controlled by the control unit couples the flywheel with gear shaft 30. The aforesaid gear shaft 30 is permanently engaged with two crank shafts 4. One crank shaft 4 belonging to crank drive 10*a* is kinematically linked by synchronizing bar 47 to one of crank shafts 4 belonging to crank drive 10*b* such that phases of shaft rotation is synchronized.

Numeral 3 refers to rocker interconnecting crank pins 115 of crank shafts 4 driven by gear shaft 30. Connecting rods 5 are hingedly secured to rocker 3. Levers 6 are hingedly to connecting rods 5. Levers 6 are slidably movable along a lower surface of crosspiece 8. Shorter arms 7 of levers 6 are hingedly connected to slider 27. Longer arm 12 of levers 6 are hingedly connected to rod nut arrangements 11 threadly movable along connecting rods 5.

As mentioned above, stop nuts 14 are engaged with threads along stanchions 2 and configured for arresting cross-piece 8 at the moment of applying a force to slider 27 by lever 6. Nuts 14 are releasably kinematically connected to one of crank drives via worm gears driving nuts 14 belonging to crosspiece 8. While longer arms 12 of lever 6 are driven by connecting rods 5 upward, shorter arms 7 of levers 6 being slidably supported by crosspiece 8 retained by stop nuts 14 belonging to crosspiece 8 apply a force generated by the crank drives 10*a*/10*b* to slider 27. While connecting rods 5 move downward, shorter arms 7 of levers 6 ease the force applied between crosspiece 8 and slider 27 and allow crosspiece 8 to descend. Nuts 14 driven by the worm gears 78 follow crosspiece 8.

Movement of connecting rod 5 upward and downward is cyclically repeated at each turn of crank shafts 4. A number of cycles constitutes an operational stroke of crank press 9.

The nuts 14 are rotated by crank drive 10*a*. The kinematic chain comprises shaft 18, controlled by coupling clutch 53, gear arrangement 42, conic transmission 80 and worm gears 78, retained by pneumatic cylinder accommodating a compressed gas therewithin and having a piston with a stick connected to the worm shaft of the worm gear by a thrust bearing such that the pneumatic cylinder compensates non-linearity of slider motion. Nuts 14 are synchronized by chain linkage 118.

An operational stroke is defined by upper stop 50 and lower stop 64. The operational stroke is performed by means of several revolutions of cranks pins 115. Lower stop 64 is configured for stopping crosspiece 8 via rigid link 15.

After arresting crosspiece 8 by lower stop 64 in lowermost position, slider 27 undergoes a last displacement downward and latchable stop 66 which in its lowest position is gripped by grip 54 due to slide clamp 55. At reverse displacement of slider 27 upward in the range of 5% of the last operation cycle, latchable stop 66 is retained in the lowest position by slide clamp 55. Left arm 56 terminal point of lever 68 pivoted at axis 67 is retained below and right arm 60—above. Longer arm 12 of lever 6 via the kinematic chain 69-58-70-49-57-16-73 switches clutch 53 such that auxiliary drive 20 is connected to gearing shaft 18 which is a differential shaft. After switching clutch 53, auxiliary drive 20 moves slider 27 to the uppermost position. Then, slide clamp 55 frees grip 54. After that, a spring (not shown) resets latchable stop 66.

Upper stop arrangement, which includes stock 17, functions similar to the latchable stop, which is a lower stop arrangement. In this case, after clutch switching over, stop nuts 13 and 14 are driven by crank drive 10*a* via differentiating shaft 18 couplable by clutch 53 downward to follow the slider.

Pneumatic cylinder 59 is configured for applying to slider 27 a constant force directed upward vertically. Therefore, crosspiece 8 and slider 27 follow ascending crosspiece stop nuts 14. Stopping the crosspiece 8 in the course of the work stroke downward by arrester 64 provides improved accuracy of performed presswork.

In the course of an operational stroke, crosspiece 8 and slider 27 are alternately displaced downward along stanchions 2 and guiding ways 26, respectively. Levers 6 are connected to nuts 11 threadly movable along connecting rods 5 by nut arrangement 71 which comprises worm shaft 19 and bevel gear 21 driven by nut arrangement drive along a distal terminal of connecting rod 5 and configured for compensating displacement of crosspiece 8. The nut arrangement drive comprises a threaded rod 24 kinematically connected to crosspiece 8 and rotatable within stationary threaded bore 25 depending of a current displacement of crosspiece 8, a splined shaft 28 being length-adjustable in order to compensate periodic displacements of connecting rod 5 and articulated shaft 121. Rotation of threaded rod 24 is transferred to warm shaft 19 such that spatial positions of said first crosspiece 8 and nut arrangement 71 are mutually coordinated.

Hydraulic cylinders 23 and 29 are designed for balancing the forces applied to stanchions 2 in the course of press operation. Specifically, hydraulic cylinder 23 is hingedly connected to longer arm 31 of first-order lever 22 displaceable around hinge 32. Shorter arm 33 of lever 22 is connected to stanchions 2 via hinge 34. Symmetrically located hydraulic cylinder 23 and lever 22 connected to stanchion 2 are not shown. Second-order levers 35 are angularly displaceable around hinge 32 and controlled by hydraulic cylinders 29. The function of levers 22 controlled by hydraulic cylinders 23 hydraulically interconnected to each other (not shown) is to balance the forces applied to stanchions 2 caused by plastic deformation of a billet.

Figure 3A:
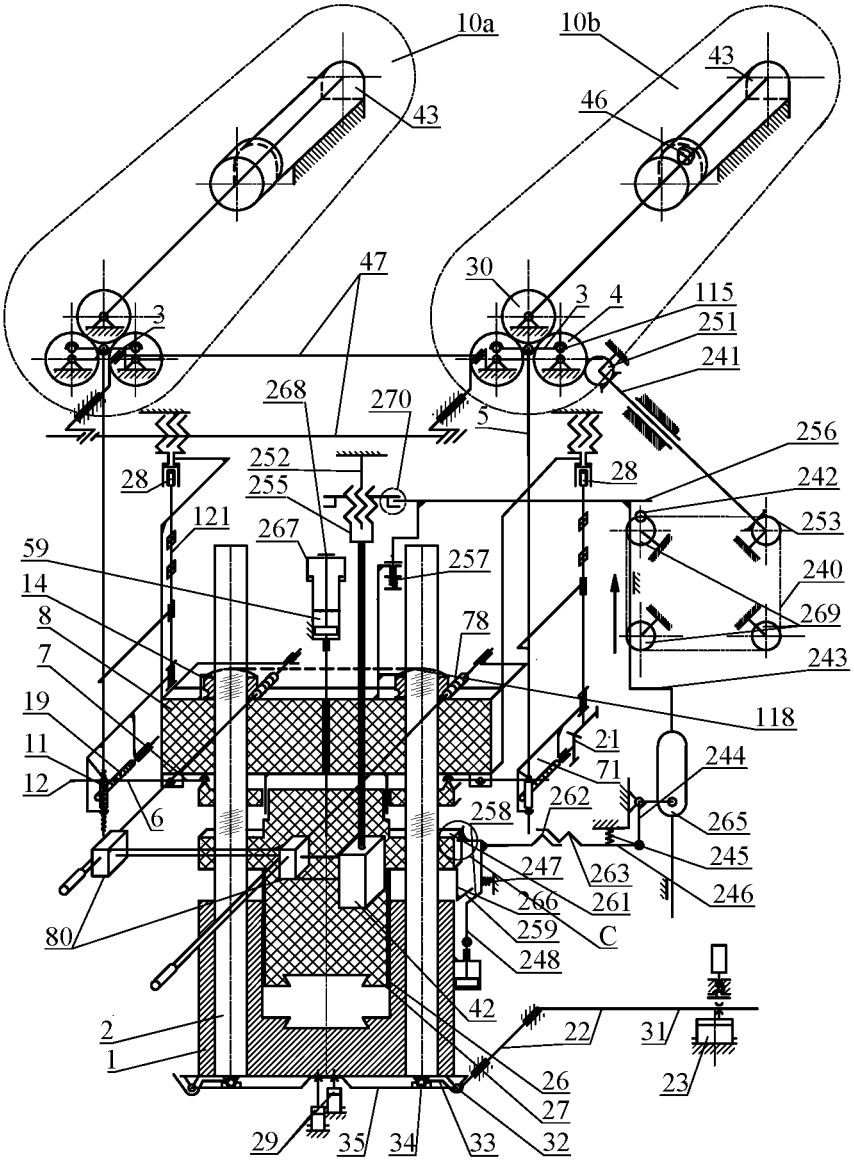
FIG. 3*a* is a kinematic scheme of an alternative embodiment of a crank press provided with a nut-retainable crosspiece.

Reference is now made to FIG. 3*a* presenting an alternative embodiment of the crank press. According to the aforesaid embodiment, instead of shaft 18 driven by crank drive 10*a* via coupling clutch 53, stop nuts 14 belonging to crosspiece 8 are driven by means of splined shaft 255 rotatable around stationary threaded pintle 252. Similar to the previous embodiment, in the course of an operational stroke, crosspiece 8 and slider 27 are alternately displaced downward along stanchions 2 and guiding ways 26, respectively. Pusher 243 is kinematically connected to crosspiece 8 via spring 257 and connected by rotatable joint to splined shaft 255. While crosspiece 8 descends in the course of the operational stroke, pusher 243 drags down splined shaft 255 such that it rotates around threaded pintle 252. The rotational torque generated on splined shaft 255 is transferred to stop nuts 14 belonging to crosspiece 8 via gear arrangement 42 and conic transmission 80 and worm gears 78 similar to the previous embodiment.

Figure 3B:
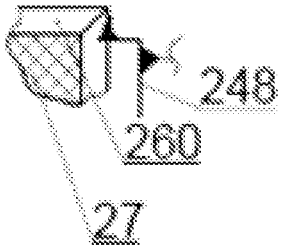
FIGS. 3*b* and 3*c* shows a slider in free and secured positions.
Figure 3C:
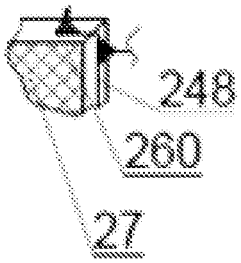

As disclosed above, the operational stroke includes a number of connecting rod cycles. FIG. 3*b* shows the position of slider 27 at the distance to its lowest position corresponding to more than two connecting rod cycles. It should be appreciated that pneumatic cylinder 57 balances slider 27. In normal position, grip 248 is pressed to side face C of slider 27. In the beginning of the next-to-last cycle, slider 27 descends such that slider face 260 to be gripped is positioned lower than locking face 261 of grip 248 as shown in FIG. 3*c* and hereat grip 248 moves to the left into a latched position. Rod stop 268 of pneumatic cylinder 59 bumps into gas spring 267 mounted on pneumatic cylinder 59. At this time, the long arm of lever 12 is pulled upwards by connecting rod 5 and continues pressing onto crosspiece 8 and deforms the article between the dies (not shown). Then, during the next half-cycle, the long arm of lever 12 moves downwards and eases pressure onto cross-piece 8. Concurrently, pneumatic cylinder 59 in combination with gas spring 267 hauls slider 27 up into a base position defined by face 260 of grip 248. Slider 27 in its base position provides a support to the short arm of lever 12 resulting in precise clamping of half-dies in the last cycle of the operational stroke.

Then, slider 27 descends again. Arm 266 is stiffly connected to slider 27. While slider 27 descends, slanted face 259 of arm 266 presses onto face 258 of grip 248 and displaces spring-loaded grip 248 to the right compressing spring 247. Fixing bar 246 is kinematically connected to slot 265 of pusher 243 via knee lever 244. Protrusion 262 enters recess 263 of fixing bar 246 pressed by spring 245 which allows slider 27 to move upward in the course of a reverse stroke.

According to the embodiment shown in FIG. 3*b*, the reverse stroke of crosspiece 8 and slider 27 is implemented by ascending movement of pusher 243 which is inserted into circumferential slot 270 drags up splined shaft 255 which rotates in the opposite direction. Specifically, the rotational torque is taken from crank shaft 4 onto cylindrical gear 251 and then via bevel gear 241 is transferred to chain pinion 253 which drives chain 240 tensioned between pinion 253 and idle sprockets 269. Chain 240 is provided with supporting roll 242 which is configured for engaging with short arm 256 of pusher 243 when supporting roll 242 carried by chain 240 moves upwards at the ascending portion D of its trajectory. Supporting roll 242 being in engagement with pusher 243 pushes it up at the ascending portion D of its trajectory and idles at the others.

Figure 4:
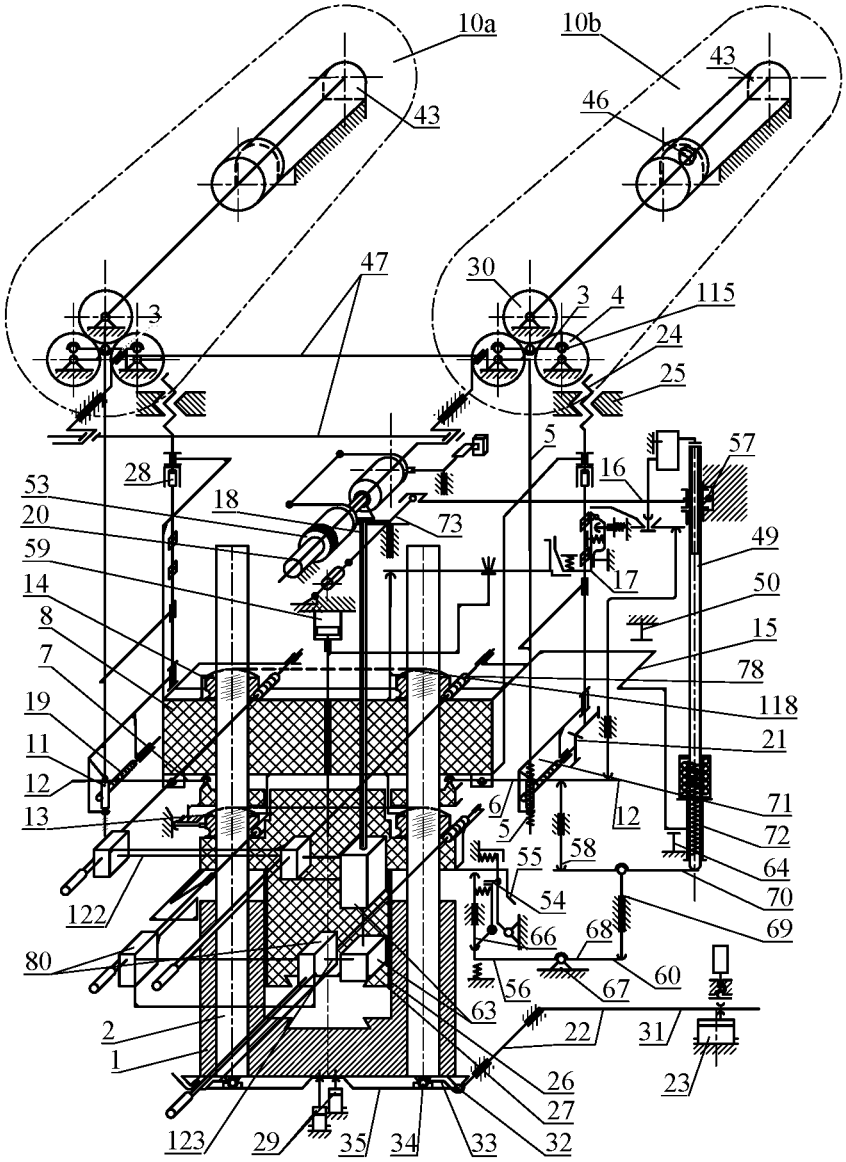
FIG. 4 is a kinematic scheme of a crank press provided with a nut-retainable crosspiece and a slider.

Reference is now made to FIG. 4 presenting a second embodiment of the present invention of a crank press provided with nut-retainable crosspiece 8 and slider 27. Stop nuts 13 belong to slider 27 while stop nuts 14 to crosspiece 8. In the case of elastic deformation of the workpiece to be pressed, a return shock appears. In order to improve accuracy of the slider work stroke, nuts 13 following slider 27 during the operational stroke prevent the aforesaid slider 27 from rebound stroke. Similar to the embodiment depicted in FIG. 2, stop nuts are driven by warm gears 78. Contrary to the previous embodiment, the crank press comprises differential transmission 63 receiving a rotational torque from shaft 18 and dividing between shafts 122 and 123 which are kinematically connected with warm gears 78 via conic transmissions 80. The warm gears are retained by pneumatic cylinder accommodating a compressed gas therewithin and having a piston with a stick connected to the worm shaft of the worm gear by a thrust bearing such that the pneumatic cylinder compensates non-linearity of slider motion.

Figure 5:
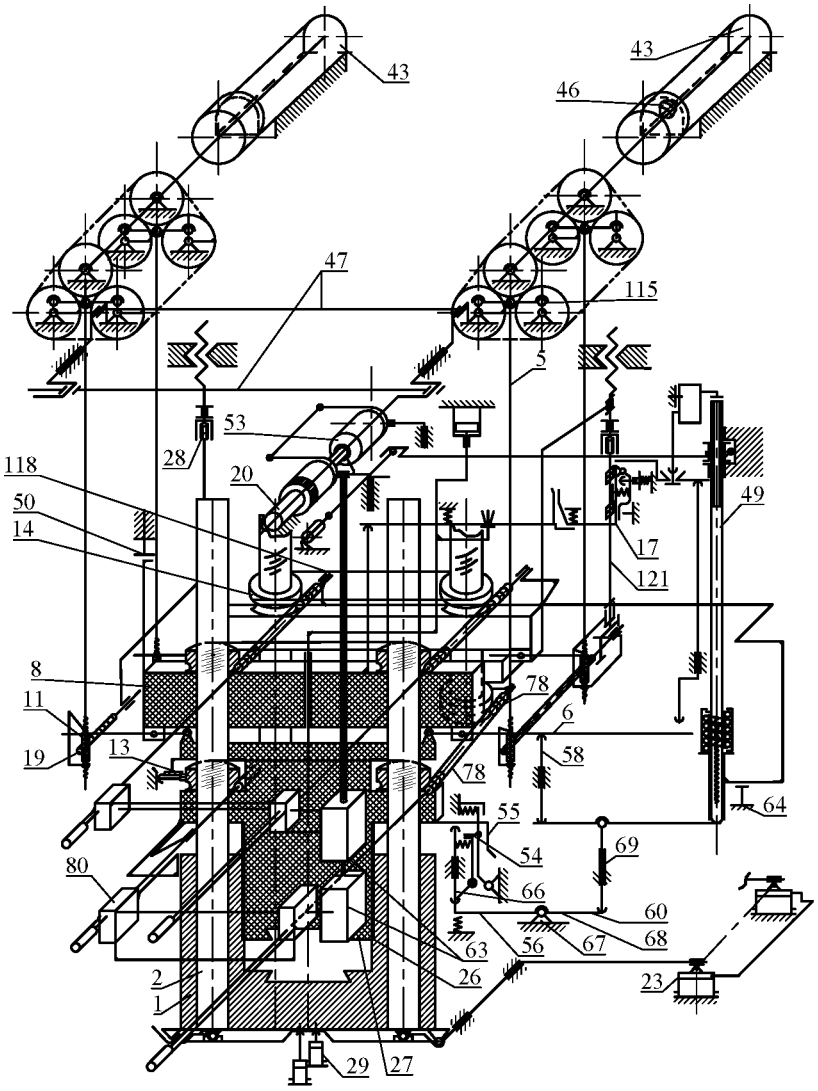
FIG. 5 is a kinematic scheme of a multi-stanchion embodiment of the crank press shown in FIG. 4.
Figure 6A:
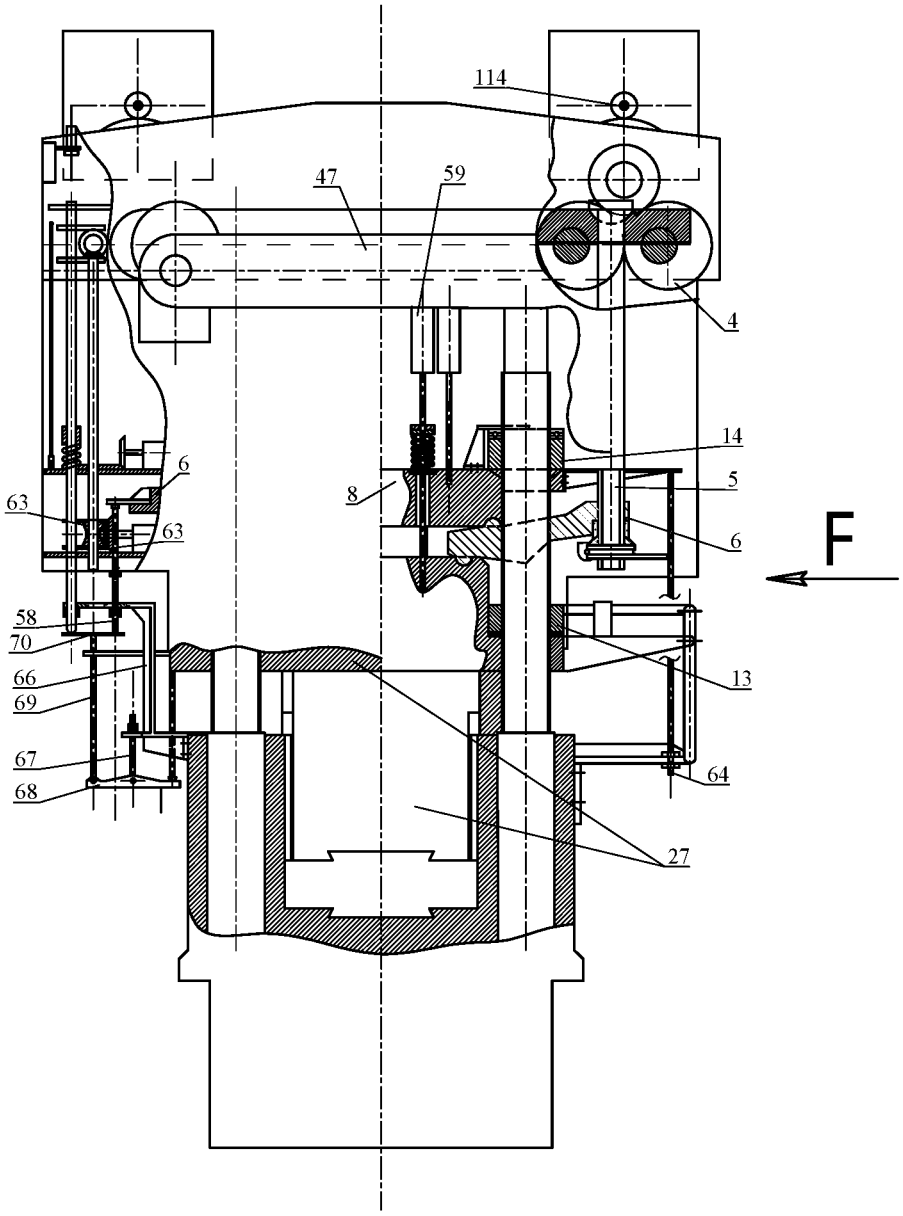
FIG. 6*a* is a sketchy front view of a crank press provided with nut-retainable crosspiece and slider.
Figure 6B:
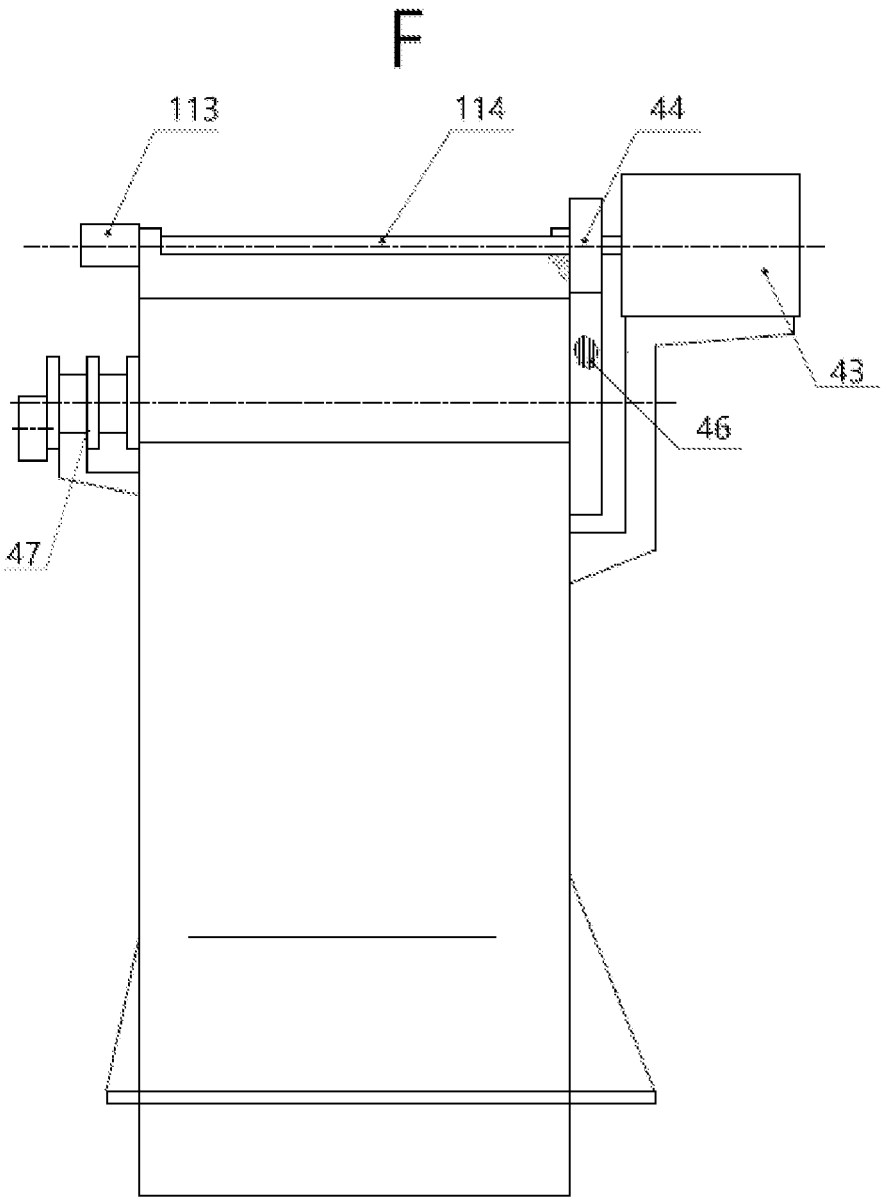
FIG. 6*b* is a side view of a crank press provided with a nut-retainable crosspiece and a slider.

Reference is now made to FIG. 5 to an embodiment of the crank press shown in FIG. 4 and comprising a number of pairs of stanchions 2. Expansion in the number of stanchions 2 and connecting rod 5-lever 6 arrangements provides increase in press tonnage without size gain of crank shafts and increase in operation efficiency.

Figure 7:
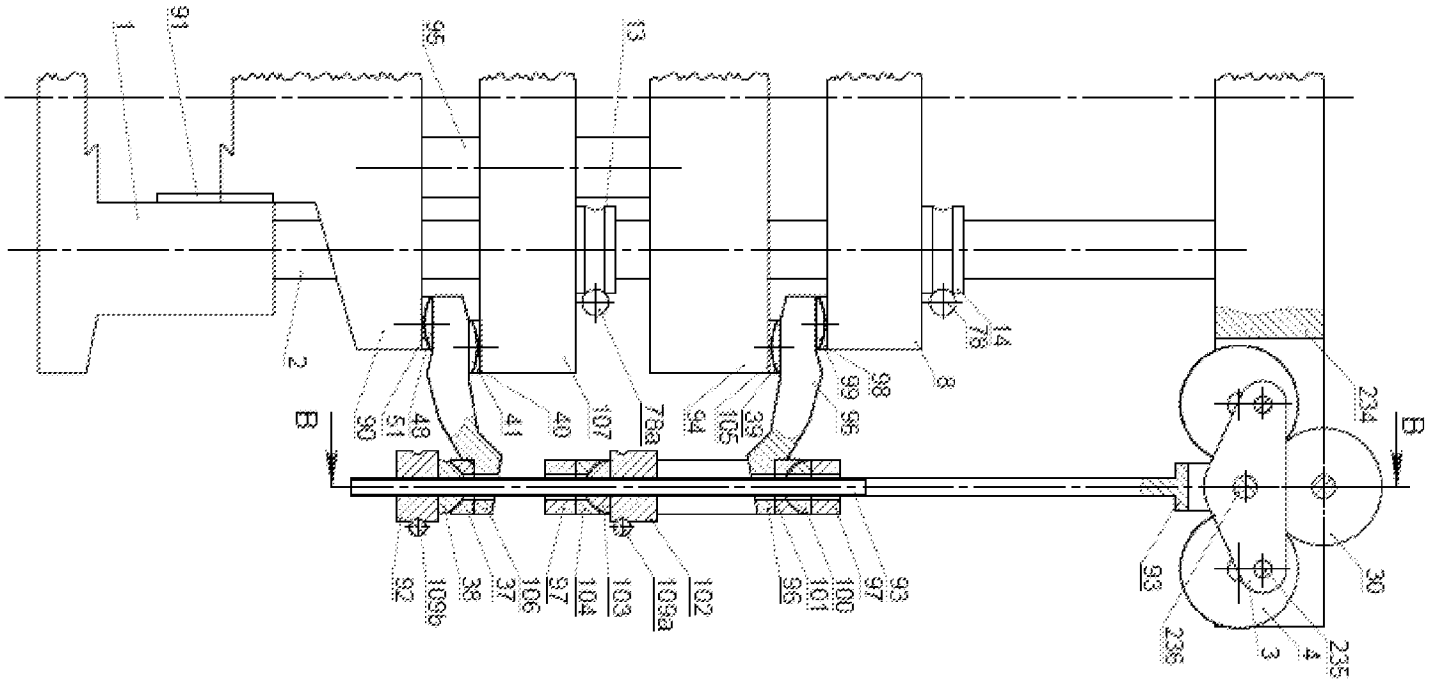
FIG. 7 is a kinematic scheme of a crank press provided with the nut-retainable crosspieces and with not-retainable by nuts slider and slider table.
Figure 8:
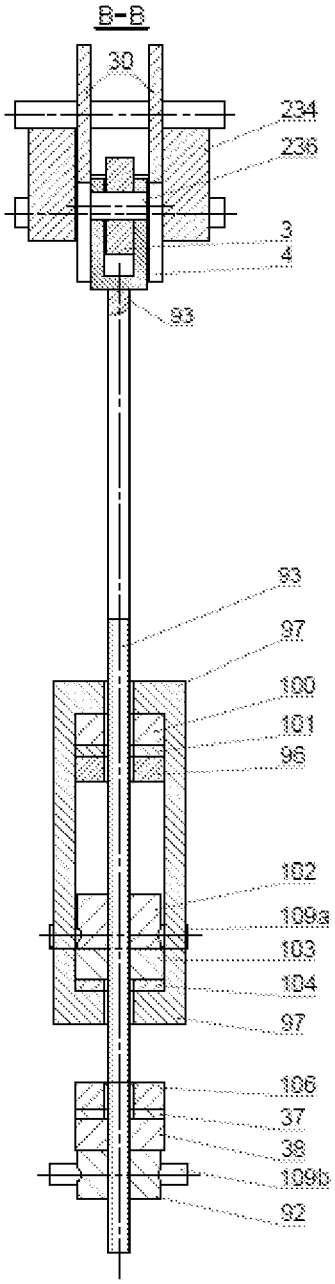
FIG. 8 is a kinematic scheme of a rod arrangement.
Figure 9:
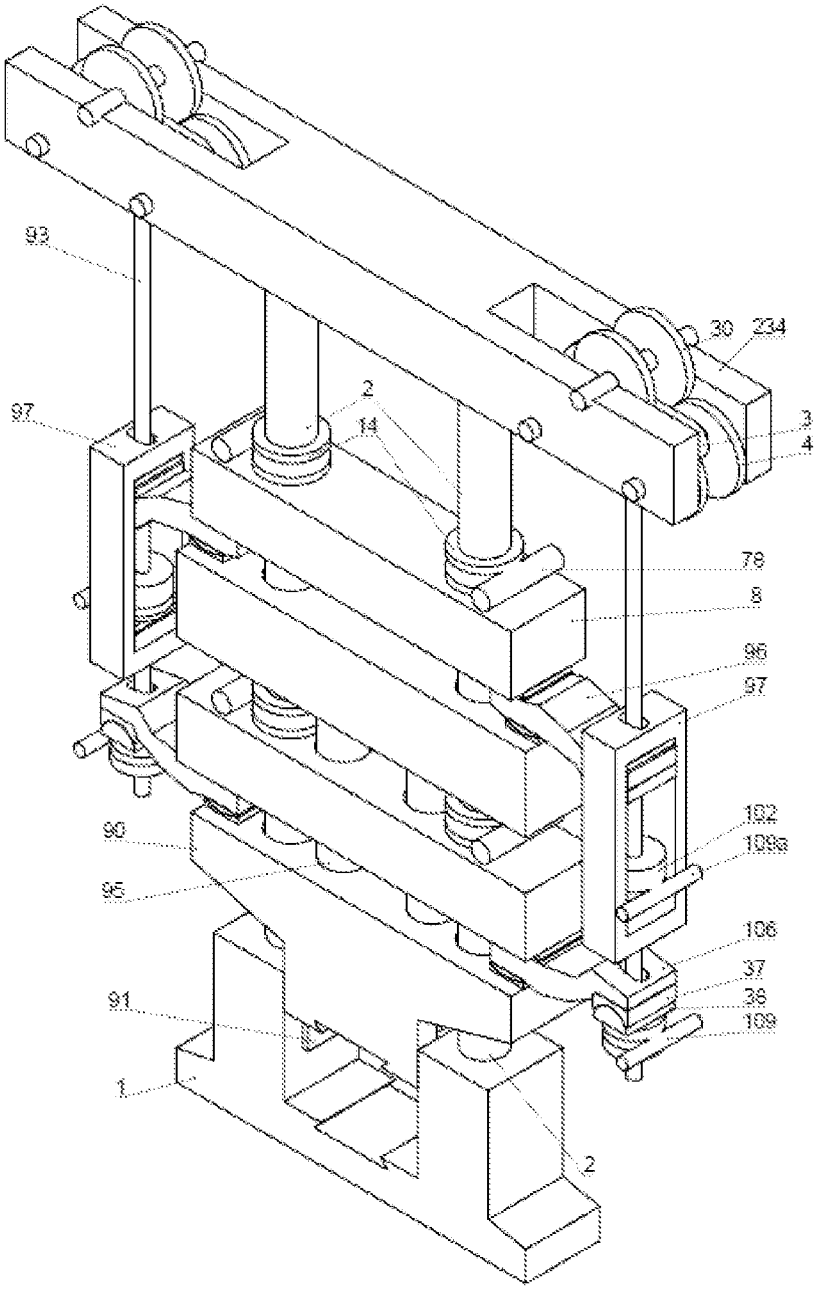
FIG. 9 is a sketchy model of a crank press provided with nut-retainable crosspieces and with the not retainable by nuts slider and slider table.

Reference is now made to FIGS. 7, 8 and 9 presenting an alternative embodiment of the present invention. Comparing the embodiments depicted in FIGS. 2 to 6 (a and b) with FIGS. 7, 8 and 9, the first ones can be interpreted as single-phase technical solutions while the last one is a two-phase crank press. Specifically, in FIGS. 2 to 6 (*a, b*), one revolution of the crank shaft corresponds to one elemental displacement of a slider in the direction of the billet along the stanchions and a crosspiece following the slider. As explained above, one revolution of the crank shaft, in FIGS. 7, 8 and 9 corresponds to two elemental displacements of slider 27. Regarding the FIG. 9, it refers to a sketchy model of a crank press provided with nut-retainable crosspieces and with the not retainable by nuts slider and slider table.

During one revolution, the crank shaft forces the connecting rod one displacement upward in the first half of the cycle and one displacement downward in the second half of the cycle. In the first half of the cycle, the lever sends the slider downward while, in the second half of the cycle, the lever allows the crosspiece to follow the slider. Thus, there is a standstill period for the slider while the crosspiece reaches the slider.

Referring to two-phase embodiment shown in FIGS. 7, 8 and 9 the lever-crosspiece mechanism comprises crank shafts 4, connecting rod 93, second-order lever 96, first-order lever 106, first crosspiece 8, second crosspiece 107, slider 90 and slider table 94 rigidly connected to slider 90. Lever 96 is disposed between first crosspiece 8 and slider table 94 while second lever 106 between second crosspiece 107 and slider 90. Positions of terminals of longer arms of levers 96 and 106 are defined by nuts 102 and 92 driven by worm gears 109*a* and 109*b*, respectively, while positions of terminals of shorter arms of the abovementioned levers 96 and 106 by crosspieces 8 and 107. Bushing 100 carries shackle 97 on its upper surface being rigidly connected to this shackle. Bushing 100 has a cylindrical surface which is in a hinge connection with bushing 101 connected to lever 96. Lower surface of internal window of shackle 97 carries bushing 104 rigidly connected to the aforesaid lower surface. Bushing 104 has a cylindrical surface which is in a hinge connection with bushing 103 supported by nut 102.

Bushings 100 and 101, lever 96, nut 102 and bushings 103 and 104 are mounted within a window 36 of shackle 97.

Bushings 37 and 38 have cylindrical surfaces which are in a hinge connection. Bushing 38 is supported by nut 92 while bushing 37 is connected to lever 106.

Bushings 99 and 39 belonging to lever 96 are in a hinge connection with bushings 98 and 105, respectively. Bushings 40 and 48 belonging to lever 106 are in a hinge connection with bushings 41 and 51, respectively.

First crosspiece 8 and second crosspiece 107 are provided with stop nuts 14 and 13 respectively.

While the longer arms of the levers 96 and 106 are driven by connecting rod 93 upward, a shorter arm of lever 96 via busing 99 and 98 eases pressure on slider table 94. Shorter arm of lever 106 slidably supported via bushing 40 and 41 by second crosspiece 107 arrested by the stop nuts 13 belonging thereto applies a force generated by the crank drive to slider 90. Stop nuts 14 belonging to first crosspiece 8 driven by the worm gears follow first crosspiece 8.

While the longer arms of levers 96 and 106 are driven by the connecting rod downward, the shorter arm of lever 96 supported via bushings 98 and 99 by a lower surface of first crosspiece 8 arrested by stop nuts 14 belonging thereto applies via bushings 39 and 105*a* force generated by the crank drive to slider table 94 and moves slider 90 connected to slider table 94 by means of elongate members of lever 96. The shorter arm of second two-arm lever 106 eases the force applied to slider 90 via bushing 48 and 51 at the previous half-cycle. Stop nuts 13 belonging to second crosspiece 107 driven by the worm gears follow second crosspiece 107.

Lower stop 110 functions similar to lower stop 64 described at this page on above. Second crosspiece 107 has stock 52 connected thereto. When stock 52 bumps into lower stopper 110, movement of second crosspiece 107 stops. As position of second crosspiece 107 is precisely defined, the final displacement of slider 90 is forced by lever 106 supported by second cross-piece in its precisely defined position and driven by connecting rod 93 in the last half-cycle of the crank shaft revolution.

Figure 10:
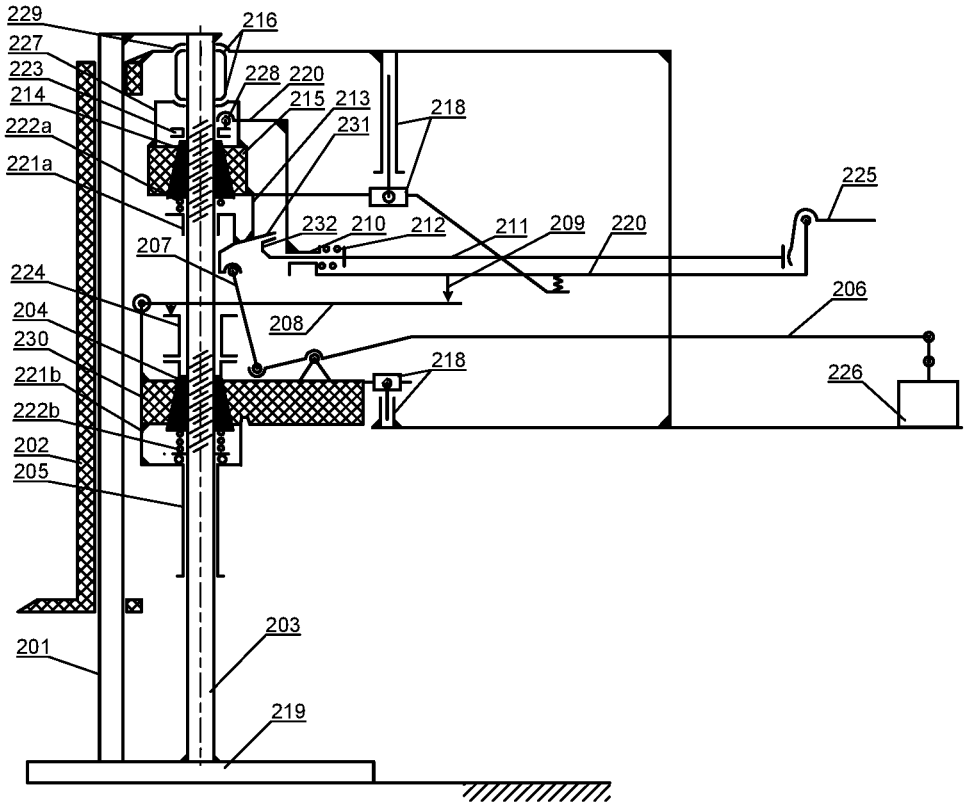
FIG. 10 is a kinematic scheme of a lifting machine provided with conic nut-retainable crosspieces.

Reference is now made to FIG. 10 presenting a lifting machine, being an alternative embodiment of the similar to the presented above crank press mechanical arrangement, the unifying characteristics of which with the crank press are:

(a) a system of slider and first cross-piece, connected and moving together in the vertical direction, i.e. a system equivalent to the slider according to crank press cinematic schemes, (b) the second cross-piece, located under the first one, (c) cross-pieces stop nuts, (d) lever-cross-piece drive, (e) threaded stanchion and (f) crank drive.

The lifting machine comprises base 219, stanchions 201 and 203 rigidly connected to base 219. Stanchion 203 has a non-self-locking thread. Stanchion 201 carries slider 202 movably mounted thereon. Stanchion 203 carries first and second crosspieces 215 and 230, respectively. The aforesaid crosspieces 215 and 230 are movable along stanchion 203.

The slider 202 is supported by its cantilever 229 on an intermediate link which is a pipe 216 with end spherical surfaces and—through this pipe—on the collar 227 of the cross-piece 215 to exclude a rigid connection in the transverse plane between the slider 202 and the cross-piece 215, making it possible for the slider to move in the transverse plane relatively the stanchion 201 within the required (in order to prevent jamming) working guaranteed minimum clearance between them, having at the same time the reciprocal angular movements of the pipe 216 relative to the stanchion 203 due to sufficient constructive internal radial clearances between them.

So, the slider 202—under the load action—puts pressure on first cross-piece 215 via pipe 216 to the collar of the cross-piece vertically downward.

First and second crosspieces 215 and 230 are supported by conic nuts 214 and 204, respectively accommodated in conformal bores within first and second crosspieces 215 and 230. Spring 222*a* supported by spring support 221*a* bumps onto conic nut 214 belonging to first crosspiece 215. Spring 222*b* supported by spring support 221*b* bumps onto conic nut 204 belonging to second crosspiece 230.

Numeral 205 refers to a guide brush preventing crosspieces 215 and 230 from skewing. Kinematic pairs 218 are designed for stabilizing crosspieces 215 and 230 in horizontal plane and preventing them from rotation around stanchion 203.

Referring to the ascending procedure, crank drive 226 moves a two-arm lever 206 which is angularly displaceable around hinge 228 connected to second crosspiece 230.

Lever 206 has a longer arm connected to crank drive 226 while its shorter arm is connected to connecting rod 207. Shorter arm, while moves upward, forces first crosspiece 215 via connecting rod 207 and support 213 to move upward either. Spring 222*a* pushes nut 214 along non-self-locking thread along stanchion 203 such that the aforesaid nut 214 follows first crosspiece 215 playlessly in its bore. A reverse motion of the shorter arm pulls second crosspiece 230 via hinge 228 upward, while the nut 214 is self-locked into the bore of the first cross-piece and therefore the cross-piece is locked on the stanchion. During the displacement of second crosspiece 230 upward, nut 204 follows second crosspiece 230 from spring pressing. At the repeated move of the cross-piece 215 upward by lever 206 nut 204 is self-locked. As described above, slider 202 configured for carrying/lifting a load is connected to first crosspiece 215 and is lifted with first crosspiece 215 together.

When there is a need for descending slider 202, nuts 204 and 214 are forcedly unlocked by lever 225. The kinematic chain activating the descending procedure is the following. Bracket support 220 is hingedly connected to thrust washer 223. Lever 225 after inclining the pushbar 211 displaceably within guideway 210, relative to bracket support 220, rotates then the pushbar 211, loaded by spring 212, together with the bracket support downward around the hinge connection of bracket support 220 to the bushing 223. The aforesaid pushbar 211 is provided with wedge surface 232 configured when being in mechanical contact with surface 231 of crosspiece 215 for applying a force to crosspiece 215 relatively the nut 214. Specifically, the abovementioned arrangement functions as a clamping mechanism which applies a force to nut 214 relative to crosspiece 215 in the direction of ejection of nut 214 from crosspiece 215 and unlocks it. Then, bracket support 220 descending together with crosspiece 215 via stock 209 presses lever 208 kinematically connected with thrust washer 224. Lever 208 is angularly displaceable relative to crosspiece 230 such that an "ejecting" force is applied between crosspiece 230 and nut 204 via thrust washer 224. Nut 204 is unbraked and crosspiece 230 descends either.

Figure 11:
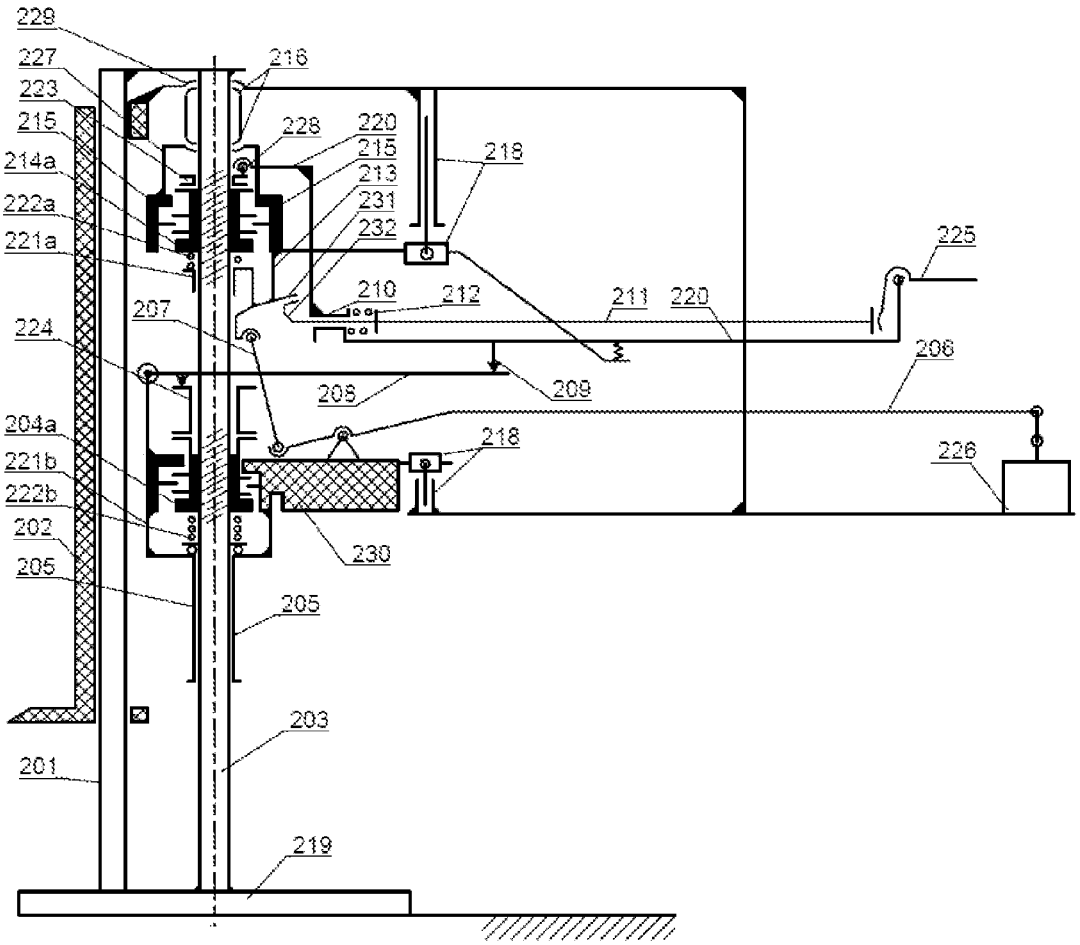
FIG. 11 is a kinematic scheme of an alternative embodiment of a lifting machine provided with multi-disc clutch nut-retainable crosspieces.

Reference is now made to FIG. 11 presenting a kinematic scheme of an alternative embodiment of a lifting machine provided with a multi-disc clutch nut-retainable crosspiece. Instead, conic nuts in FIG. 9, the multi-disc clutch nuts are used for retaining crosspieces 215 and 230 on stanchion 203. The multi-disc clutch nuts arrangement comprises: (a) hubs 214*a* and 204*a* on stanchion 203; clutch discs 233; the hubs 214*a* and 204*a* having non-self-braking internal thread corresponding to the previously mentioned thread on the stanchion 203; the hubs 214*a* and 204*a* having external movable travel engagement with internal engagement said discs 233; (b) cross-pieces 215 and 230 having internal movable travel engagement with external engagement said disks 233. In the ready position the entire set when assembled is pressed by springs 222*a* and 222*b*.

Just after the ascending procedure and till the descending one beginning the entire set of friction discs is compressed with the amount of compression equal to the load. At the calculated amounts of diameters of the discs and the number of discs it ensures self-locking of the hubs against rotation relatively the crosspieces under any loads under the mentioned non-self-braking thread of the stanchion 203.

While the invention has been particularly shown and described with reference to an embodiment thereof, it will be appreciated by those skilled in the art that various changes in form and detail may be made without departing from the spirit and scope of the invention.

APPENDIX

List of References

1 base
2 stanchions
3 rocker
4 crank shaft
5 connecting rod
6 lever
7 shorter arm
8 crosspiece
9 basic embodiment
10*a* and 10*b* crank drives
11 nut of the rod nut arrangement
12 longer arm
13 stop nuts
14 stop nuts
15 rigid link
16 pull bar
17 stock of the upper stop arrangement
18 vertical shaft
19 worm shaft
20 auxiliary drive
21 bevel gear
22 first order lever
23 hydraulic cylinder
24 threaded rod
25 threaded bore
26 guiding ways
27 slider
28 splined shaft
29 hydraulic cylinder
30 gear shaft
31 longer arm
32 hinge
33 shorter arm of lever 22
34 hinge
35 second-order lever
36 window
37 bushing
38 bushing
39 bushing
40 bushing
41 bushing
42 gear arrangement
43 main electric motor
46 controllable clutch
47 synchronizing mechanism
48 bushing
49 stock-shaft
50 upper stop
51 bushing
52 stock
53 coupling clutch
54 grip
55 slide clamp
56 left arm of lever 68
57 lever
58 stock
59 pneumatic cylinder
60 right arm of lever 68
63 differential transmission
64 lower stop
66 latchable stop
67 axis
68 lever
69 stock
70 lever arm
71 rod nut arrangement
72 threaded bore
73 lever
78 worm gear
80 conic transmission
90 slider
92 nut
93 connecting rod
94 slider table
96 second-order lever
97 shackle
98 bushing
99 bushing
100 bushing
101 bushing
102 nut
103 bushing
104 bushing
105 bushing
106 first-order lever
107 second crosspiece
109*a* worm shaft
109*b* worm shaft
110 lower stopper
113 flywheel
114 drive shaft

115 crank pin
118 chain linkage
121 articulated shaft
122 shaft
123 shaft
201 stanchion
202 slider
203 stanchion
204 conic nut
204*a* hub
205 guide brush
206 two-arm lever
207 connecting rod
208 lever
209 stock
210 guideway
211 push bar
212 spring
213 support
214 conic nut
214*a* hub
215 first crosspiece
216 pipe with end spherical surfaces
218 kinematic pair
219 base
220 bracket support
221*a* and 221*b* spring supports
222*a* and 222*b* springs
223 thrust washer
224 thrust washer
225 lever
226 crank drive
227 collar
228 hinge
229 cantilever
230 second cross-piece
231 wedge surface
232 wedge surface
233 clutch discs
240 chain
241 bevel gear
242 supporting roll
243 pusher
244 knee lever
245 spring
248 grip
252 pintle
253 chain pinion
255 splined shaft
256 short arm
257 spring
259 arm slanted face
260 grip face
261 locking face
262 protrusion
263 recess of fixing bar
265 pusher slot
266 arm
267 gas spring
268 rod stop
269 idle sprockets
270 circumferential slot
300 crank press
302 electric power feeder
305 control unit
310*a* and 310*b* main electric motors
320*a* and 320*b* clutches
330*a* and 330*b* crank shafts
340*a* and 340*b* connecting rod-lever mechanisms
350*a* and 350*b* tracking mechanisms
360 synchronizing linkage
370 switchable clutch
380 switching mechanism
390*a* and 390*b* kinematic chains

The invention claimed is:

1. A crank press with an adjustable stroke; said press comprising:

a. a press frame having a frame slideways therewithin with a slider reciprocatively movable therealong and supported by a first pneumatic cylinder;

b. at least two mutually synchronized crank drives configured for reciprocatively moving said slider along said frame slideways; each crank drive comprising a main motor, a flywheel, a controllable clutch, a pinion shaft, a first crank shaft and a connecting rod kinematically connected in series such that said connecting rod moves said slider in downward and upward manners;

wherein said press further comprises a lever-crosspiece mechanism further comprising:

a. at least one pair of threaded guide stanchions secured within a frame bed;

b. a first crosspiece slidably mounted on said guide stanchions atop said slider;

c. at least two two-arm levers slidably movable along a lower surface of said first crosspiece; a shorter arm of each two-arm lever is hingedly connected to said slider; a longer arm of each two-arm lever is hingedly connected to a rod nut by a rod nut arrangement;

d. at least one pair of first-crosspiece stop nuts engaged with threads of said guide stanchions and configured for arresting said cross-piece at the moment of applying a force to said slider by said levers; and e. at least one nut arrangement threadly movable along a distal terminal of said connecting rod;

while said longer arms of said two-arm levers is driven by said connecting rod upward, shorter arms of said two-arm levers being slidably supported by said first crosspiece retained by said first-crosspiece stop nuts belonging thereto applies a force generated by said crank drives to said slider;

while said connecting rod moves downward, said shorter arm of said two-arm lever eases said force applied between said first crosspiece and said slider and allows said first crosspiece to descend; said first-crosspiece stop nuts driven by worm gears follow said first crosspiece.

2. The crank press according to claim 1, wherein said first-crosspiece stop nuts are driven by said worm gears kinematically constantly engaged with said first-crosspiece stop nuts; said worm gears are kinematically connected to one of said crank drives in a releasable manner.

3. The crank press according to claim 1 comprising a first length-adjustable splined shaft rotatable around a stationary threaded pintle by a pusher mechanically connected to said first crosspiece; said pusher is configured for applying an axially directed thrust to said first splined shaft such that a rotational torque is generated; said first splined shaft is kinematically constantly engaged with said first-crosspiece stop nuts.

4. The crank press according to claim 2 or 3 comprising at least one pair of slider stop nuts configured for arresting said slider and preventing a backblow due to an elastic deformation of an article to be pressed; said slider stop nuts are kinematically connected to one of said crank drives via worm gears; said worm gears driving said slider stop nuts are connected to said crank drive in parallel to said worm gears driving said first-crosspiece stop nuts via a differential transmission.

5. The crank press according to claim 2 comprising a first auxiliary reverse stroke drive, switching mechanism and a lower stop, wherein said first auxiliary reverse stroke drive is synchronized with one of said crank shafts, and said switching mechanism further comprises a switch clutch configured for coupling a differential transmission and worm gears driving said stop nuts to said crank drive and said auxiliary reverse stroke drive in an alternative manner; said lower stop is applied to stop the cross-piece at its adjustable penultimate stroke point to get die closing.

6. The crank press according to claim 3, wherein a second auxiliary reverse stroke drive comprises a chain wheel gear arrangement comprising at least two sprockets and a chain tensioned therebetween partially ascendably movable in parallel with said pusher; at least one of said sprockets is constantly kinematically connected to said crank shaft; said chain carries a supporting roll engageable with said pusher at an ascending part of movement trajectory thereof such that said first length-adjustable splined shaft is pushed by said pusher and rotates around said stationary threaded pintle in a reversed direction.

7. The crank press according to claim 6 comprising a grip arrangement for precisely positioning said slider before a last operational cycle in a base position; said grip arrangement further comprises a spring-loaded grip kinematically connected to said pusher and configured for latching said slider in said base position before said last operational cycle and a gas spring cooperatively operating with said first pneumatic cylinder and activated when said slider is positioned at or lower than said base position.

8. The crank press according to claim 7, wherein said spring-loaded grip has gripping and idle positions; said spring-loaded grip latches said slider in said gripping position when said slider descends to a position thereof lower than said base position and is shifted into said idle position by a fixing bar kinematically connected to said pusher via a knee lever.

9. The crank press according to claim 1, wherein said at least two crank drives comprise at least one second crank shaft mounted in parallel with said first crank shaft; said at least one of said first crankshafts and the at least one second crankshaft are engaged with each of said pinion shafts and driven thereby; said at least two second crank drives comprise a rocker connected to crank pins of said first and at least one second crankshaft; a proximal terminal of said connecting rod is hingedly connected to a middle of said rocker.

10. The crank press according to claim 1 comprising a drive of said nut arrangement of said connecting rod moving said nut arrangement of said connecting rod along said distal terminal of said connecting rod; said drive of said nut arrangement of said connecting rod comprises a threaded rod kinematically connected to said first crosspiece and rotatable within a stationary threaded bore according to said displacement of said first crosspiece, a second length-adjustable splined shaft and kinematically connected to said threaded rod and engaged with a connecting rod worm shaft driven by said threaded rod via said second splined shaft engaged with an articulated shaft engaged with a bevel transmission such that spatial positions of said first crosspiece and nut arrangement of said connecting rod are mutually coordinated.

11. The crank press according to claim 1, wherein each of said worm gears of said stop nuts comprises a second pneumatic cylinder accommodating a compressed gas therewithin and having a piston with a stick connected to a worm shaft of said worm gear by a thrust bearing.

12. The crank press according to claim 1, wherein said at least one pair of stop nuts comprise a self-locking thread.

13. The crank press according to claim 1 comprising:

a. a second crosspiece mounted on said guide stanchions; said second crosspiece mounted under said first crosspiece;

b. a slider table rigidly connected to said slider and movably mounted on said guide stanchions between said first and second crosspiece;

c. at least two first and two second two-arm levers oriented opposite to each other; said first and second two-arm levers are slidably movable over an upper surface of said slider table and a lower surface of said second crosspiece, respectively; shorter arms of said first and second two-arm lever are hingedly connected to a lower surface of said first crosspiece and an upper surface of said slider, respectively; longer arms of said first and second two-arm levers are hingedly connected to said first and second connecting rod nut arrangements, respectively;

d. at least one pair of second-crosspiece stop nuts engaged with threads of said guide stanchions and configured for arresting said second crosspiece at a moment of applying a force thereon by said levers;

said at least one pair of said first-crosspiece stop nuts and at least one pair of said second-crosspiece stop nuts are releasably kinematically connected to one of said crank drives via a differential transmission and worm gears driving said first-crosspiece and second-crosspiece nuts independently;

e.

while said longer arms of said first and second two-arm levers are driven by said connecting rod upward, a shorter arm of said first two-arm lever eases pressure on said slider table and a shorter arm of said second two-arm lever slidably supported by said second crosspiece arrested by said nuts belonging thereto applies a force generated by said crank drive to said slider; said nuts belonging to said first crosspiece driven by said worm gears follow said first crosspiece;

while said longer arms of said first and second two-arm levers are driven by said connecting rod nut arrangement downward, said shorter arm of said first two-arm lever hingedly supported by said lower surface of said first crosspiece arrested by said stop nuts belonging thereto applies a force generated by said crank drive to said slider table and moves said slider; said shorter arm of said second two-arm lever eases pressure on said slider; said nuts belonging to said second crosspiece driven by said worm gears follow said second crosspiece.

14. A lifting machine:

a. comprising:

a. a base member, b. a crank drive; and c. a vertically movable slider;

wherein said lifting machine further comprises a lever-crosspiece mechanism further comprising:

a. first and second stanchions vertically secured to said base member; second stanchion threaded therealong; and b. first and second crosspieces movably mounted on said second stanchion; said second crosspiece mounted under said first crosspiece;

said slider being movable along said first stanchion is supported by said first cross-piece; the second stanchion is provided with a non-self-locking thread; each of the first and second crosspieces comprising a conical nut mounted within a tapered bore of the first and second crosspieces; the nuts threadly coupled with the second stanchion; the conic nuts are stoppable on the second stanchion in a self-locking manner by a gravitational force applied by said crosspieces and a load to be lifted to the conic nuts within the bore and are rotationally movable along the second stanchion in a non-self-locking manner by applying a force to said conic nuts relative to said crosspiece in a direction of ejecting said conic nut out of said bore of said crosspiece; and c. a two-arm lever hingedly connected to said second crosspiece; said two-arm lever having a longer arm connected to said crank drive such that said crank drive swingingly moves said two-arm lever around a hinge axis thereof;

while the terminal point of said longer arm of said two-arm lever is moved downward by said reciprocative drive, a short arm of said two-arm lever applies a force generated by said reciprocating drive to said first crosspiece such that said first crosspiece ascends and said spring-loaded conical nut belonging thereto follows said first crosspiece along said second stanchion; said second crosspiece hingedly supports said two-arm lever while said conical nut belonging to said second crosspiece is locked and said second crosspiece is steady relative to said second stanchion;

while the terminal point of said longer arm of said two-arm lever is moved upward by said crank drive, said second crosspiece is pulled up; said second crosspiece ascends along said second stanchion; said conical nut belonging to said second crosspiece rotationally follows said second crosspiece.

15. The lifting machine according to claim 14 comprising a descending arrangement comprising an auxiliary drive and two releasing bushings kinematically connected to said auxiliary drive; said two releasing bushings are configured for reduction of contact normal forces between said tapered bores and said conical nuts or contact forces between frictional discs such, that a friction force between said tapered bores and said conical nuts or between frictional discs is reduced.

16. The lifting machine according to claim 14, wherein said auxiliary drive is a manual drive.

17. A lifting machine comprising:

a. a base member;

b. a crank drive; and c. a vertically movable slider;

wherein said lifting machine further comprises a lever-crosspiece mechanism further comprising:

a. first and second stanchions vertically secured to said base member; said second stanchion threaded thereal-ong; and b. first and second crosspieces movably mounted on said second stanchion; said second crosspiece mounted under said first crosspiece; said slider being movable along said first stanchion is supported by said first crosspiece; the second stanchion is provided with a non-self-locking thread; each of the first and second crosspieces comprising multi-disc clutch nuts mounted within bores of the first and second crosspieces; each of said multi-disc clutch nuts having internal engagement frictional discs mounted between external engagement disks in the bores of said first and second crosspieces; and said the multi-disc clutch nuts threadly coupled with the second stanchion; the multi-disc clutch nuts are stoppable on the second stanchion in a self-locking manner when loaded with a gravitational force applied by said crosspieces and a load to be lifted to the multi-disc clutch nuts within the bores and are rotationally movable along the second stanchion in an non-self-locking manner by applying a force to said multi-disc clutch nuts relative to said crosspiece in a direction of ejecting said multi-disc clutch nuts out of said bores of said first and second crosspieces;

c. a two-arm lever hingedly connected to said second crosspiece; said two-arm lever having a longer arm connected to said crank drive such that said crank drive swingingly moves said two-arm lever around a hinge axis thereof; while said longer arm of said two-arm lever is moved downward by a reciprocating drive, a short arm of said two-arm lever applies a force generated by said reciprocating drive to said first crosspiece such that said first crosspiece ascends together with said multi-disc clutch nut belonging thereto, while said multi-disc clutch nut rotationally moves along said second stanchion in a non-self-locking manner; said second crosspiece hingedly supports said two-arm lever while said multi-disc clutch nut belonging to said second crosspiece is locked and said second crosspiece is steady relative to said second stanchion; while said longer arm of said two-arm lever is moved upward by said crank drive, said second crosspiece is pulled up; said second crosspiece ascends along said second stanchion; said multi-disc clutch nut belonging to said second crosspiece rotationally moves along said second stanchion.

* * * * *